US006208218B1

(12) United States Patent
Ishiura et al.

(10) Patent No.: US 6,208,218 B1
(45) Date of Patent: Mar. 27, 2001

(54) NONRECIPROCAL CIRCUIT DEVICE INCLUDING DIELECTRIC WAVE GUIDE, DIELECTRIC WAVE GUIDE DEVICE AND RADIO DEVICE

(75) Inventors: Yutaka Ishiura, Kyoto; Hiromu Tokudera, Nagaokakyo; Katsuyuki Ohira, Otsu, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/309,658

(22) Filed: May 11, 1999

(30) Foreign Application Priority Data

May 13, 1998 (JP) ..... 10-130265

(51) Int. Cl.[7] ..... H01P 1/32; H01P 3/16
(52) U.S. Cl. ..... 333/1.1; 333/24.2
(58) Field of Search ..... 333/1.1, 24.2

(56) References Cited

U.S. PATENT DOCUMENTS 3,246,261 * 4/1966 Stelzer ..... 333/1.1
4,276,522 6/1981 Coerver ..... 333/1.1
5,781,086 * 7/1998 Kato et al. ..... 333/1.1 X

FOREIGN PATENT DOCUMENTS 0700113 3/1996 (EP) .

OTHER PUBLICATIONS

Hiroyuki Yoshinaga Et Al.; "Design and Fabrication of a Nonradiative Dielectric Waveguide Circulator" IEEE Transactions on Microwave Theory and Techniques, vol. 36, No. 11, Nov. 1, 1988 (Nov. 1988), pp. 1526–1531, FIG. 1.

* cited by examiner

*Primary Examiner*—Justin P. Bettendorf
(74) *Attorney, Agent, or Firm*—Ostrolenk, Faber, Gerb & Soffen, LLP

(57) ABSTRACT

A dielectric wave guide nonreciprocal circuit device wherein the efficiency of applying a DC magnetic field to ferrite plates is increased, the effect on other components of magnetic field leakage from magnets is reduced, and changes in the DC magnetic field, when other magnetic bodies are nearby, are reduced. The dielectric wave guide has dielectric strips clasped between conductive plates. Ferrite plates are provided at a center portion where the dielectric strips converge. Magnets are provided in concavities formed in outer sides of the conductive plates. A closed magnetic path is formed by surrounding the whole structure with magnetic members having side walls.

22 Claims, 7 Drawing Sheets

NONRECIPROCAL CIRCUIT DEVICE INCLUDING DIELECTRIC WAVE GUIDE, DIELECTRIC WAVE GUIDE DEVICE AND RADIO DEVICE

BACKGROUND OF THE INVENTION

1. Field of the Invention

The present invention relates to a nonreciprocal circuit device using a dielectric wave guide, a dielectric wave guide device incorporating the nonreciprocal circuit device, and a radio device using the dielectric wave guide device.

2. Description of the Related Art

A conventional circulator using a nonradiative dielectric wave guide (hereinafter an "NRD guide") has been described in Electronic Data Communications Academy Bulletin EMCJ92-54, MW92-94 (1992-10) "60 GHz Band NRD Guide Gunn Oscillator," and Electronic Data Communications Academy Research Papers C-I, Vol. J77-C-I, No. 11, pp. 592–598, November 1994, "60 GHz Band FM Gunn Oscillator using an NRD Guide".

FIG. 9 shows a conventional configuration of a circulator using the above NRD circuit. In FIG. 9, three dielectric strips 3, 4 and 5 are provided between two conductive plates 1 and 2 to form an NRD guide, and ferrite plates 6 and 7 are provided at the portion where these three dielectric strips join. Then, magnets 8 and 9 are provided so as to sandwich the ferrite plates 6 and 7 from outside the conductive plates 1 and 2.

A ferrite resonator comprising the ferrite plates 6 and 7 is excited by an electromagnetic wave which is transmitted through the dielectric strips. A DC magnetic field is applied vertically to the surfaces of the ferrite plates 6 and 7. At this time, due to the ferromagnetic characteristics of the ferrite plates, the permeability of the ferrite plates differs depending on the direction in which the high-frequency magnetic field rotates, and as a result the polarized wave faces rotate, functioning as a circulator.

However, in the conventional circulator using an NRD guide shown in FIG. 9, the DC magnetic field is not applied efficiently to the ferrite plates, since only single-body magnets are provided for this purpose. Furthermore, leakage of the magnetic field from the single-body magnets affects the other components, and when other magnetic bodies are nearby, there is a possibility that the DC magnetic field applied to the ferrite plates may be affected and varied adversely.

It has been considered to include a closed magnetic circuit of the type used in a circulator for the microwave band (without an NRD guide), in the circulator for the millimeter wave band using an NRD guide as described above. However, the NRD guide presents special problems. That is because an NRD guide has a particular configuration wherein a dielectric strip, used as a transmission line, passes between upper and lower conductive plates, and consequently steps must be taken to ensure that the electrical field of the dielectric strip is not affected. Therefore, the conventional closed magnetic circuit that is used in the conventional circulator in the microwave band cannot be used together with the NRD guide without alteration.

SUMMARY OF THE INVENTION

Accordingly, it is an object of the present invention to provide a nonreciprocal circuit device including a dielectric wave guide in which the problems described above have been solved, a dielectric wave guide device incorporating the nonreciprocal circuit device, and a radio device using the dielectric wave guide device.

The nonreciprocal circuit device of the present invention comprises a dielectric wave guide comprising dielectric strips provided between two substantially parallel conductive planes, the dielectric strips being in contact with the conductive planes, ferromagnetic plates which are provided substantially parallel to the conductive planes and in the vicinity of end faces of the dielectric strips, a magnetic field source such as a magnet disposed in at least one position, and another magnetic field source such as a magnet or a magnetic pole being disposed in another position to sandwich the ferromagnetic plates, and magnetic members forming a closed magnetic path between the magnet and the other magnet or the magnetic pole.

Thus, since a magnet and another magnet or a magnetic pole are disposed to sandwich ferromagnetic plates, such as ferrite plates, and magnetic members form a closed magnetic circuit between the magnet and the other magnet or the magnetic pole, leakage of magnetic field from the magnet is suppressed and the strength of the DC magnetic field applied to the ferromagnetic plates increases even without increasing the magnetomotive force of the magnets. Further, the effect of leakage of magnetic field to other components is reduced, and changes in the DC magnetic field applied to the ferromagnetic plates due to a nearby magnetic body are reduced.

The magnetic members sandwich the dielectric wave guide, the magnet, and the other magnet or magnetic pole, and in addition, the magnetic members form side walls of the dielectric wave guide. The magnetic members may include magnetic yokes or plates made of magnetic material, and such magnetic plates may be connected by screws made of magnetic material so as to secure the magnet and the other magnet or magnetic pole. With this constitution, the dielectric wave guide and the magnets can be joined together by the magnetic members.

The dielectric strips are arranged at respective angles of approximately 120° with the ferromagnetic plates in the center, and the magnetic members are provided in positions between respective pairs of dielectric strips, at respective angles of approximately 120° with the ferromagnetic plates in the center. It is therefore possible to achieve a three-port circulator.

The magnetic members are provided at a distance from the dielectric strips which is equal to or greater than ¼ of the wavelength on the dielectric wave guide. As a result, the magnetic members have almost no influence on the electromagnetic field of the dielectric wave guide.

The invention also relates to a dielectric wave guide device, comprising the above-described nonreciprocal circuit device, and further including a dielectric wave guide, thereby providing a dielectric wave guide circuit such as a coupler or a primary radiator, for example.

The invention relates further to a radio device, such as a radar module, for example, comprising a primary radiator, a transmission portion and/or a receiving portion, in combination with the above-described dielectric wave guide device.

The above, and other features and advantages of the invention will be better understood from the following description of embodiments thereof, with reference to the drawings.

DESCRIPTION OF EMBODIMENTS OF THE INVENTION

A constitution of a circulator using an NRD guide according to a first embodiment of the present invention will be explained with reference to FIGS. 1A to 4.

Figure 1A:
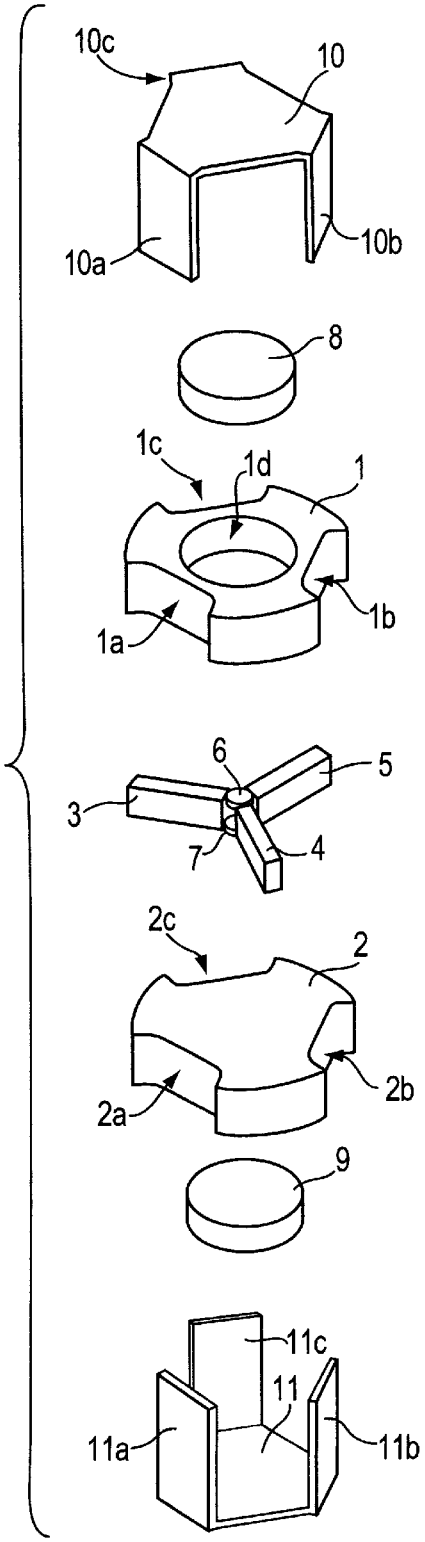
FIG. 1A is an exploded perspective view of an NRD guide circulator according to a first embodiment.
Figure 1B:
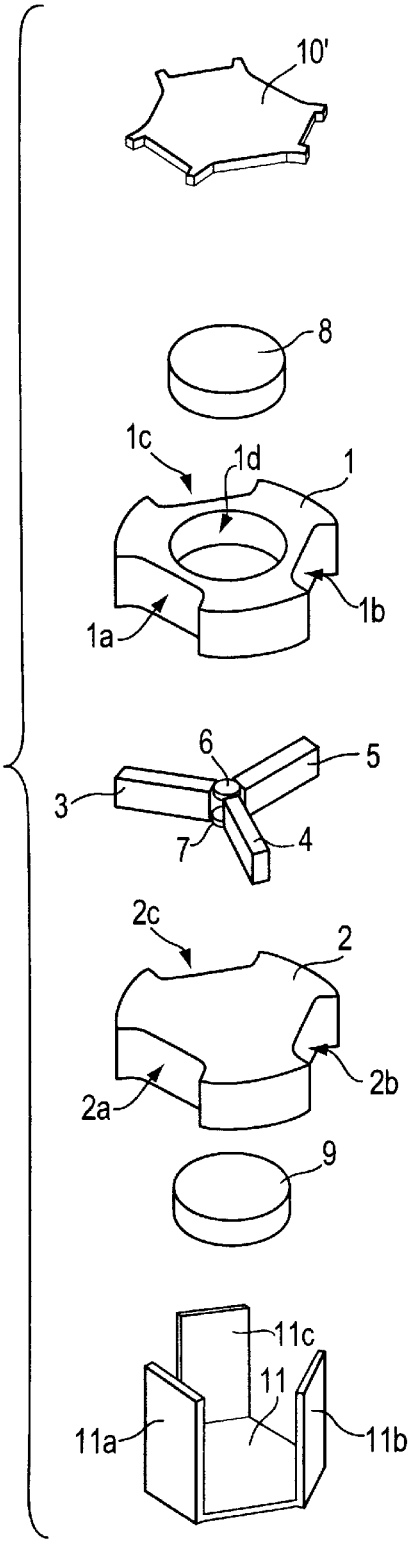
FIG. 1B is an exploded perspective view of an NRD guide circulator according to a modification of the first embodiment.

FIGS. 1A and 1B show exploded perspective views of two different types of circulator. In FIG. 1A, conductive plates 1 and 2 have opposing faces which are flat and substantially parallel. Between these two conductive plates 1 and 2, two ferrite plates 6 and 7 are provided, at the center of three radially arranged dielectric strips 3, 4 and 5. The dielectric strips 3, 4 and 5 extend radially from the ferrite plates 6 and 7 and define angles of 120° between each pair of dielectric strips 3, 4 and 5, thereby forming three NRD guides. The dielectric strips 3, 4 and 5 are in contact with the conductive plates 1 and 2.

To locate the ferrite plates 6 and 7 in the vicinity of the ends of the dielectric strips, the ferrite plates 6 and 7 may be attached to opposite ends of a dielectric tube (not shown). Alternatively, stepped portions (not shown) may be formed at the ends of the dielectric strips 3, 4 and 5 facing their radial center, so that the ferrite plates 6 and 7 can be fixed in position on the dielectric strips 3, 4 and 5 by mounting the ferrite plates 6 and 7 on the stepped portions.

Recessed portions for receiving cylindrical or disk-shaped magnets are provided on the outer sides of the conductive plates 1 and 2. 1*d* is the recessed portion of the upper conductive plate 1. The recessed portion of the lower conductive plate is not shown.

Magnetic yokes 10 and 11 have side walls 10*a*, 10*b*, 10*c*, 11*a*, 11*b* and 11*c* respectively.

When these components are assembled, the dielectric strips 3, 4 and 5 and the ferrite plates 6 and 7 are sandwiched between the conductive plates 1 and 2, the magnets 8 and 9 are received in the recessed portions in the conductive plates 1 and 2, and the magnetic yokes 10 and 11 are provided outside the other components, thereby forming a single structure.

Notches (notch-like portions) 1*a*, 1*b*, 1*c*, 2*a*, 2*b* and 2*c* are provided in the conductive plates 1 and 2 at angles of 120°, each notch being disposed between a respective pair of the dielectric strips 3, 4 and 5. The side walls of the magnetic yokes 10 and 11 engage with these notches. Therefore, 60° angles are defined between dielectric strips extending from the center in three directions at angles of 120° and the corresponding side walls of the magnetic yokes therebetween.

In the example shown in FIG. 1B, the upper magnetic yoke 10' is flat, and the ends of the side walls 11*a*, 11*b* and 11*c* of the lower magnetic yoke 11 engage with the magnetic yoke 10'. Otherwise, the constitution is the same as FIG. 1A.

Figure 2A:
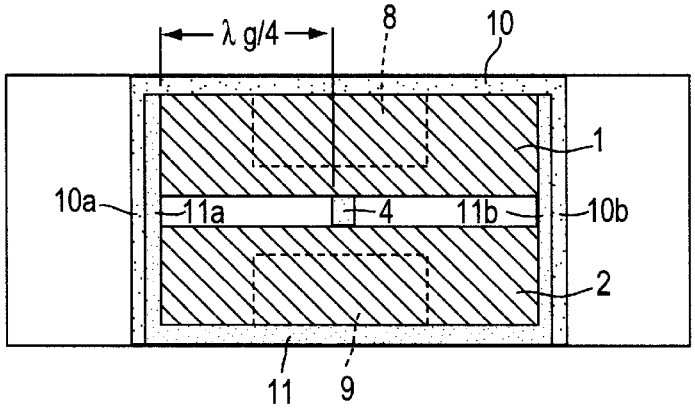
FIG. 2A is a cross-sectional view and FIG. 2B is a plan view of the circulator of FIG. 1A.
Figure 2B:
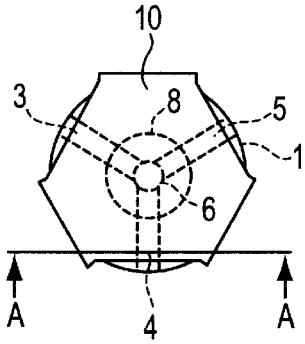

FIG. 2B is a top view and FIG. 2A is a cross-sectional view taken along the line A—A of FIG. 2B, showing the assembled state of the circulator of FIG. 1A. The opposing faces of the upper and lower conductive plates 1 and 2 form parallel conductive planes, and an NRD guide is formed by these conductive planes and the dielectric strip 4 provided in between. When the wavelength of the electromagnetic millimeter waves to be transmitted is λ, by narrowing the gap between the conductive plates 1 and 2 to less than λ/2, propagation of polarized electromagnetic waves which are parallel to the conductive plates is blocked in the portions where there are no dielectric strips. The distance between the side walls 11*a* and 11*b* of the magnetic yokes and the dielectric strip 4 is set to be λg/4 or more at its shortest point (where λg is the wavelength of the NRD guide). As a result, there is almost no electromagnetic field leakage into the space between the conductive plates 1 and 2, other than within the dielectric strip 4.

Figure 3:
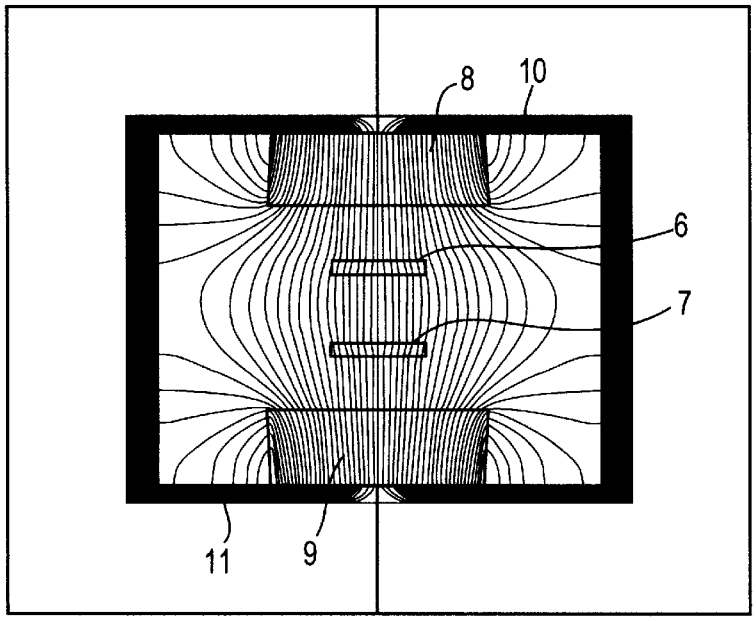
FIG. 3 is a diagram showing an example of a magnetic field distribution through a ferrite plate portion in the circulator of FIG. 1A.
Figure 4:
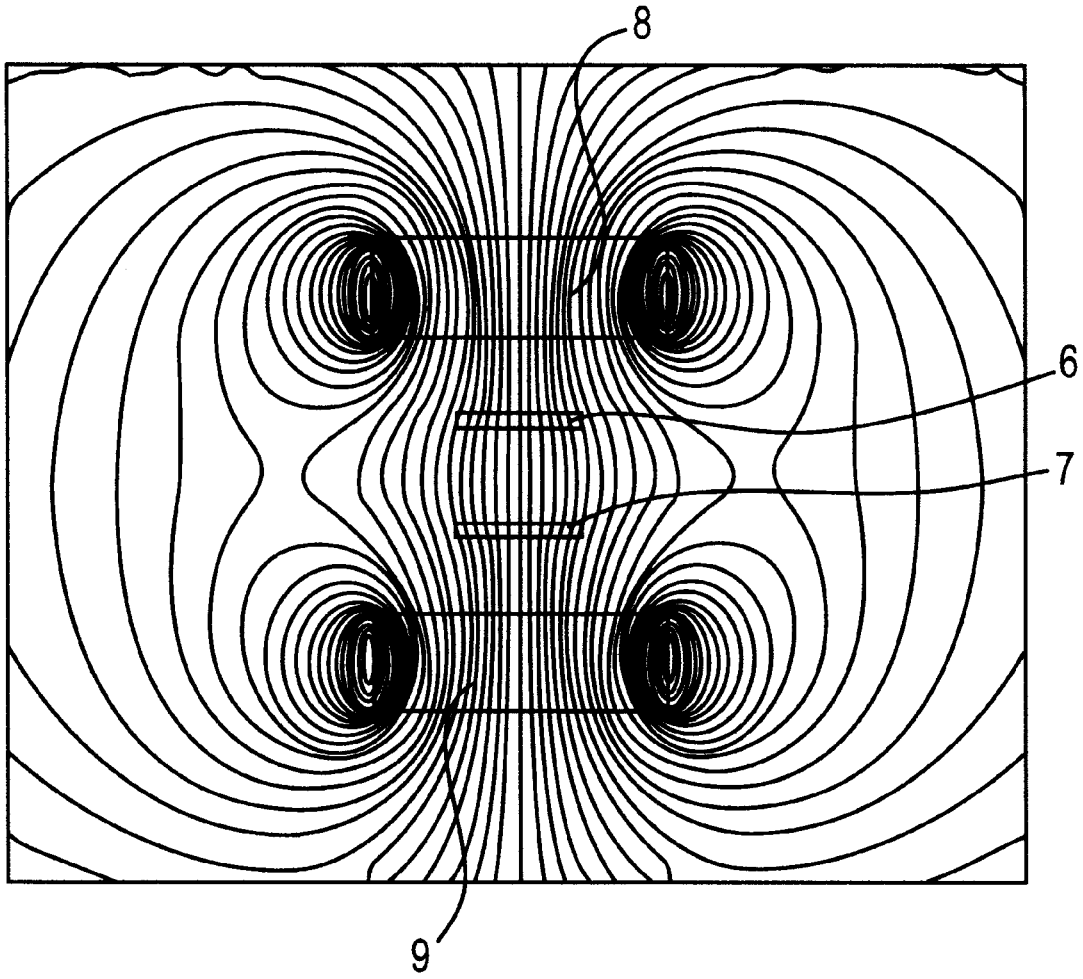
FIG. 4 PRIOR ART
FIG. 4 is a diagram showing an example of magnetic field distribution through a ferrite plate portion in a conventional circulator.

FIG. 3 shows a magnetic field distribution in the circulator of FIG. 1A, shown together with a central cross-sectional view taken through the ferrite plates 6 and 7 and the side walls 10*a*, 10*b*, 11*a* and 11*b* of the magnetic yokes 10 and 11. FIG. 4 shows a magnetic field distribution in a conventional circulator. In these diagrams, the curved lines represent magnetic lines of force. As is clear from a comparison of the two diagrams, in FIG. 3, the magnets 8 and 9 and the magnetic yokes 10 and 11 form a closed magnetic circuit, that is, magnetic lines of force in the magnets 8 and 9 pass through the side walls 10*a*, 10*b*, 11*a* and 11*b* of the magnetic yokes 10 and 11, and the strength of the DC magnetic field applied to the ferrite plates 6 and 7 is increased by providing the ferrite plates 6 and 7 in the middle of the magnetic circuit. Furthermore, there is almost no leakage of magnetic field outside the magnetic yokes 10 and 11.

Figure 5:
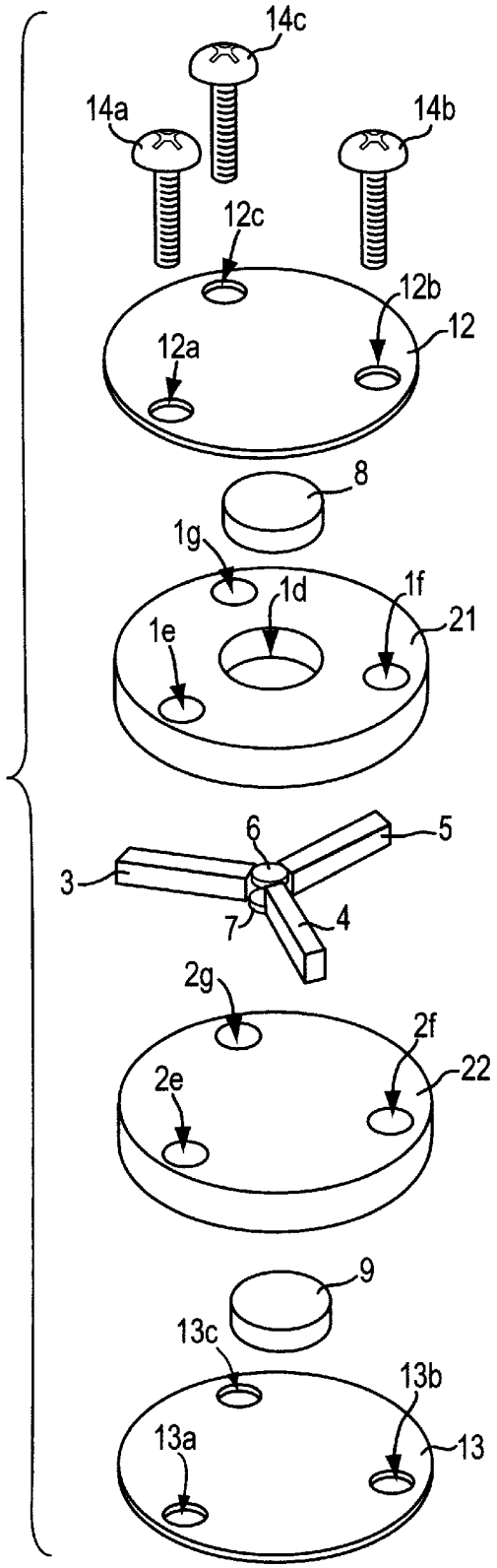
FIG. 5 is an exploded perspective view of an NRD guide circulator according to a second embodiment.

FIG. 5 is an exploded perspective view of a constitution of an NRD guide circulator according to a second embodiment of the invention. In this diagram, dielectric strips 3, 4 and 5 are provided between circular disk-shaped conductive plates 21 and 22, and ferrites 6 and 7 are provided in a central portion, as in the embodiment described above. Recessed portions for accommodating the magnets 8 and 9 are provided on the outer sides of the conductive plates 21 and 22. 1*d* is the recessed portion for accommodating the upper magnet 8 in the upper conductive plate 21, and the recessed portion in the lower conductive plate 22 is not shown. Also provided are magnetic plates 12 and 13 and magnetic screws 14*a*, 14*b* and 14*c*. The magnetic screws 14*a*, 14*b* and 14*c* pass through through-holes 12*a*, 12*b* and 12*c*, provided in the magnetic plate 12, and screw into screw holes 13*a*, 13*b* and 13*c*, provided in the magnetic plate 13. Furthermore, the magnetic screws 14*a*, 14*b* and 14*c* pass through holes 1*e*, 1*f*, 1*g* and 2*e*, 2*f*, 2*g*, provided in the conductive plates 21 and 22 respectively.

The above constituent components are sequentially provided in layers, the magnetic screws 14*a*, 14*b* and 14*c* being screwed into the screw holes 13*a*, 13*b* and 13*c* respectively in the bottom magnetic plate 13, to form a single structure.

In this state, the upper and lower magnetic plates 12 and 13 and the magnetic screws 14*a*, 14*b* and 14*c* form a closed magnetic circuit which includes the magnets 8 and 9.

Figure 6:
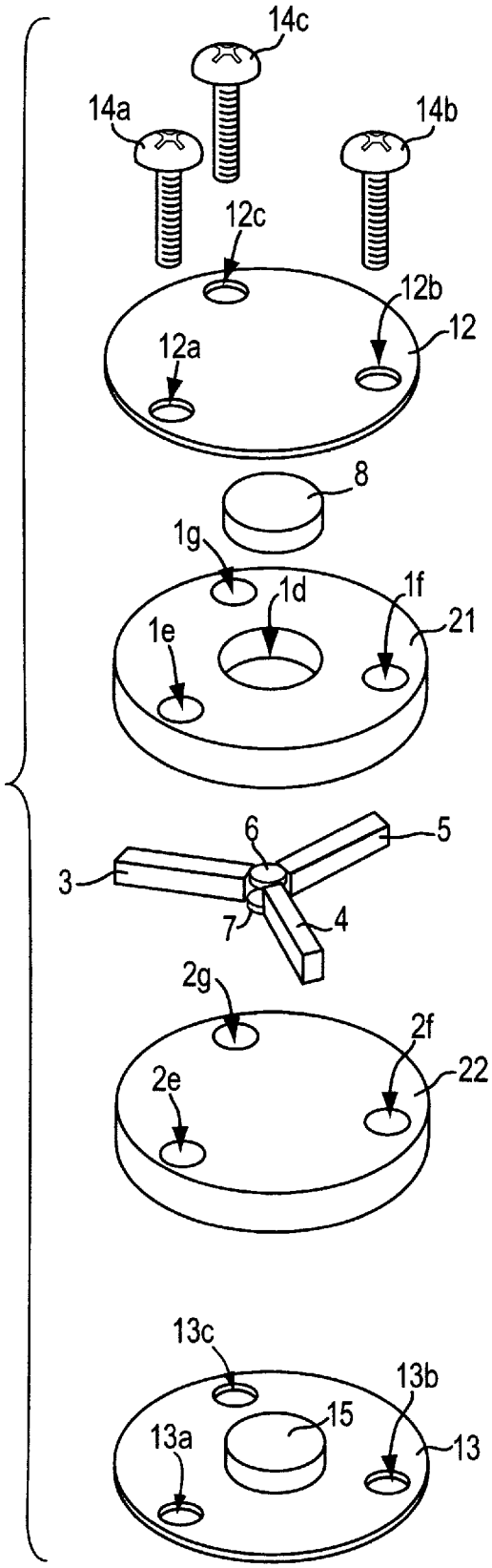
FIG. 6 is an exploded perspective view of an NRD guide circulator according to a third embodiment.

In the examples depicted in FIG. 1 and FIG. 5, two magnets 8 and 9 were provided in positions sandwiching the ferrite plates, but either one of these may alternatively be a magnetic pole. An example of this is shown as a third embodiment in FIG. 6. In FIG. 6, a magnetic pole 15 is glued or deposited on the lower magnetic plate 13. In other respects the constitution is the same as FIG. 5.

Next, an example applied in a millimeter wave radar module will be explained with reference to FIG. 7 and FIG. 8.

Figure 7:
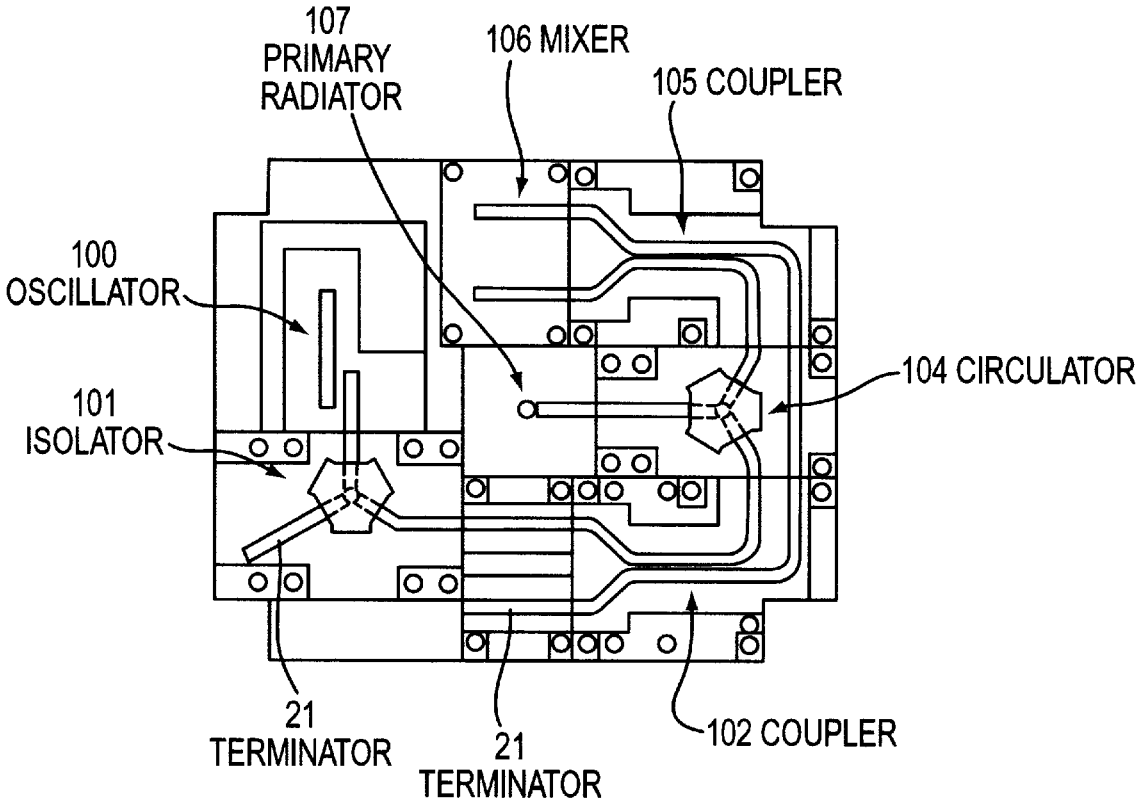
FIG. 7 is a diagram showing a constitution of a millimeter wave radar module.
Figure 8:
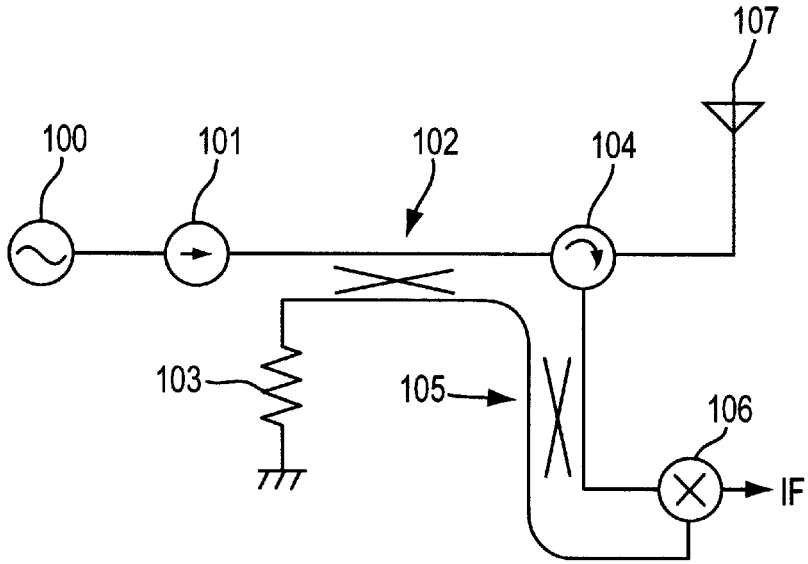
FIG. 8 is an equivalent circuit diagram of the millimeter wave radar module of FIG. 7.
Figure 9:
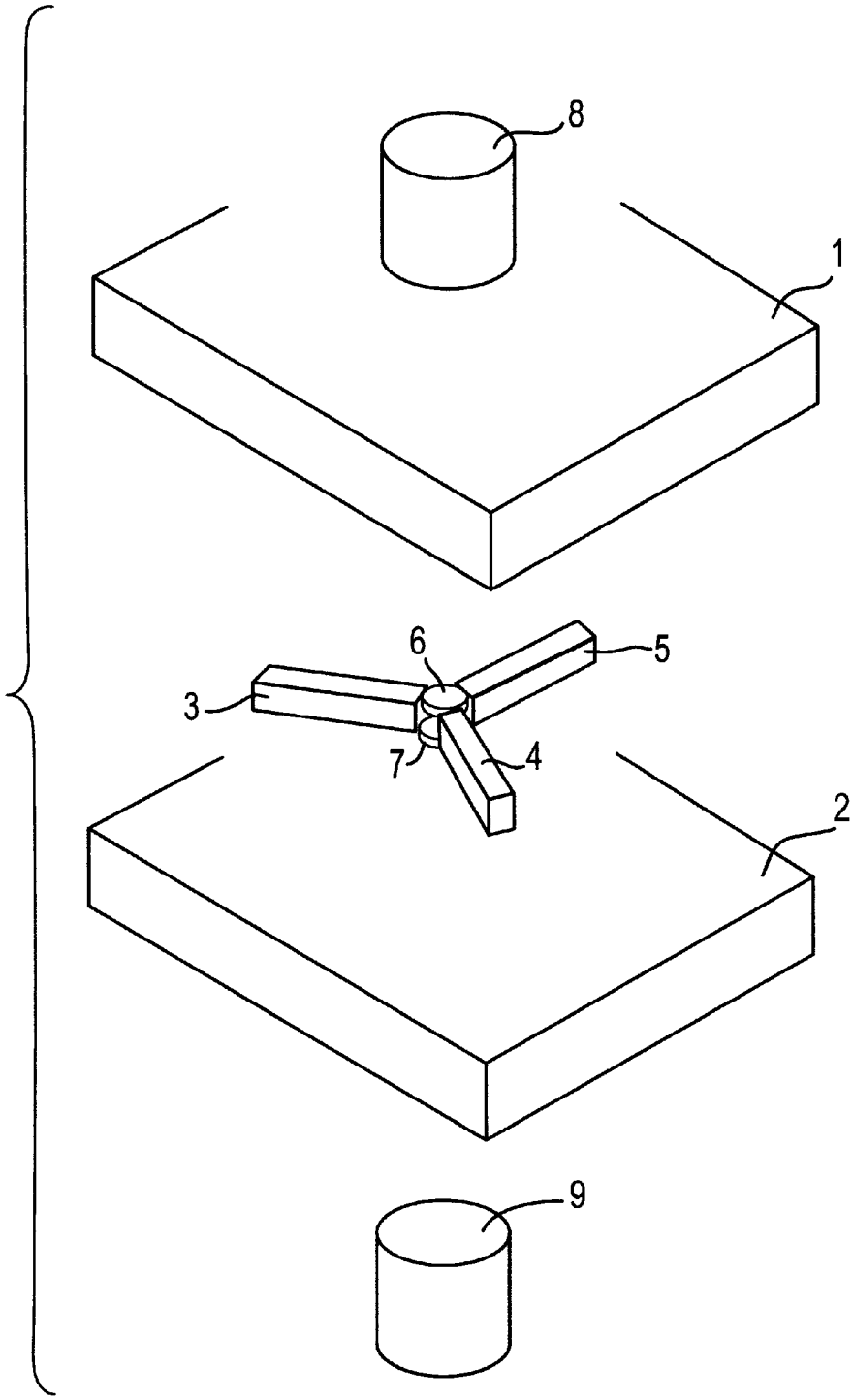
FIG. 9 PRIOR ART
FIG. 9 is an exploded perspective view of a constitution of a conventional NRD guide circulator.

FIG. 7 is a plan view of a complete millimeter wave radar module when the upper conductive plate is removed, and FIG. 8 is an equivalent circuit diagram of the same. The module broadly divides into units of an oscillator 100, an isolator 101, a coupler 102, a circulator 104, a coupler 105, a balanced mixer 106 and a primary radiator 107. A transmission section of the module includes the oscillator 100, the isolator 101, the coupler 102 and the circulator 104. A receiving section of the module includes the circulator 104, the coupler 105 and the mixer 106. The units are connected by NRD guides as transmission lines. The oscillator 100 comprises a Gunn diode and a varactor diode, and outputs an oscillating signal to the input port of the isolator 101. The isolator 101 comprises a circulator and a terminator 21 connected to a port from which a reflected signal of the circulator is extracted. The circulator utilizes any one of the first to third embodiments. The coupler 102 extracts an Lo (local oscillator) signal from two dielectric strips placed close to each other. The circulator 104 outputs a transmission signal to the primary radiator 107, and a receiving signal received from the primary radiator 107 to the coupler 105. The coupler 105 couples the receiving signal and the Lo signal, and applies these two signals to the mixer 106. The balanced mixer 106 mixes these two signals to obtain an IF (intermediate frequency) signal.

The controller of the above millimeter wave radar module uses, for instance, an FM-CW system to determine the distance and relative speed to a detected object by controlling the oscillating frequency of the oscillator 100 and signal-processing the IF signal.

The above embodiments have described an NRD guide in which the propagation of electromagnetic waves is blocked in portions where there are no dielectric strips, by making the space between opposing conductive plates equal to or less than half the wavelength of the propagated millimeter waves. However, the present invention is not limited to an NRD guide, and other conventional dielectric wave guides can be employed.

Furthermore, a three-port circulator was mentioned as an example of a nonreciprocal circuit device, but the present invention can be applied generally to any device having nonreciprocal circuit characteristics using the tensor permeability and being provided with the ferromagnetic plates arranged substantially parallel to the conductive planes and in the vicinity of end faces of the dielectric strips which are in contact with the conductive planes.

In each of the above embodiments, ferrite plates were provided near end faces of the dielectric strips which are in contact with the conductive plates, but just one ferrite plate may be provided on any one of the faces. The number of ferrite plates is not limited to one or two, and multiple plates may be provided in predetermined places. Furthermore, the ferrite plates do not have to be cylindrical or disk-shaped; for instance, a polygonal shape is acceptable.

According to the present invention, magnetic members such as yokes, or plates and screws, for example, form a closed magnetic circuit between a magnet and another magnet, or a magnetic pole, which are provided so as to sandwich ferromagnetic plates, such as ferrite plates. Consequently, magnetic field leakage from the magnets is reduced, and the strength of a DC magnetic field applied to the ferromagnetic plates can easily be increased. Furthermore, the effect of magnetic field leakage to other components is reduced, and the effect of nearby magnetic bodies on the DC magnetic field applied to the ferromagnetic body is also reduced.

In particular, the dielectric wave guide and magnets can be joined together by magnetic yokes, or plates and screws, for example.

Furthermore, a three-port circulator can easily be achieved.

Moreover, the magnetic members have almost no effect on the electromagnetic field of the dielectric wave guide, whereby desired characteristics can easily be obtained.

Although embodiments of the invention have been described herein, the invention is not so limited, but extends to all modifications and variations that may occur to those having the ordinary level of skill in the pertinent art, within the fair spirit and scope of the invention.

What is claimed is:

1. A nonreciprocal circuit device comprising:

a dielectric wave guide comprising three dielectric strips disposed between and in contact with two substantially parallel conductive planes;

ferromagnetic plates provided substantially parallel to said conductive planes and in the vicinity of end faces of said dielectric strips;

two DC magnetic field sources disposed in respective positions on opposite sides of said ferromagnetic plates; and magnetic material members forming a magnetic path between said two magnetic field sources;

wherein said dielectric strips are arranged radially with respect to a center, at respective angles of approximately 120° with said ferromagnetic plates in the center, and said magnetic material members are provided at positions circumferentially between respective adjacent pairs of said dielectric strips and at respective angles of approximately 120°; and wherein said magnetic material members are provided at a distance from said dielectric strips which is equal to or greater than ¼ of the wavelength of said dielectric wave guide.

2. The nonreciprocal circuit device according to claim 1, wherein said magnetic material members enclose said dielectric wave guide and said magnetic field sources and form side walls of said dielectric wave guide.

3. The nonreciprocal circuit device according to claim 1, wherein said magnetic material members comprise screws made of magnetic material, which secure said magnetic field sources.

4. The nonreciprocal circuit device according to claim 1, wherein said two magnetic field sources are magnets.

5. The nonreciprocal circuit device according to claim 1, wherein at least one of said two magnetic field sources is a magnetic pole.

6. The nonreciprocal circuit device according to claim 5, wherein the other of said two magnetic field sources is a magnet.

7. A dielectric wave guide device comprising in combination:

a nonreciprocal circuit device comprising:

a dielectric wave guide comprising three dielectric strips disposed between and in contact with two substantially parallel conductive planes;

ferromagnetic plates provided substantially parallel to said conductive planes and in the vicinity of end faces of said dielectric strips;

two DC magnetic field sources disposed in respective positions on opposite sides of said ferromagnetic plates; and magnetic material members forming a magnetic path between said two magnetic field sources;

wherein said dielectric strips are arranged radially with respect to a center, at respective angles of approximately 120° with said ferromagnetic plates in the center, and said magnetic material members are provided at positions circumferentially between respective adjacent pairs of said dielectric strips and at respective angles of approximately 120°; and wherein said magnetic material members are provided at a distance from said dielectric strips which is equal to or greater than ¼ of the wavelength of said dielectric wave guide; and an additional dielectric wave guide electromagnetically coupled to said nonreciprocal circuit device.

8. The dielectric wave guide device according to claim 7, wherein said additional dielectric wave guide is an NRD guide.

9. The dielectric wave guide device according to claim 7, wherein said magnetic material members enclose said dielectric wave guide and said magnetic field sources and form side walls of said dielectric wave guide.

10. The dielectric wave guide device according to claim 7, wherein said magnetic material members comprise screws made of magnetic material, which secure said magnetic field sources.

11. The dielectric wave guide device according to claim 7, wherein said two magnetic field sources are magnets.

12. The dielectric wave guide device according to claim 7, wherein at least one of said two magnetic field sources is a magnetic pole.

13. The dielectric wave guide device according to claim 12, wherein the other of said two magnetic field sources is a magnet.

14. A radio device comprising:

a primary radiator;

a nonreciprocal circuit device comprising:

a dielectric wave guide comprising three dielectric strips disposed between and in contact with two substantially parallel conductive planes;

ferromagnetic plates provided substantially parallel to said conductive planes and in the vicinity of end faces of said dielectric strips;

two DC magnetic field sources disposed in respective positions on opposite sides of said ferromagnetic plates; and magnetic material members forming a magnetic path between said two magnetic field sources;

wherein said dielectric strips are arranged radially with respect to a center, at respective angles of approximately 120° with said ferromagnetic plates in the center, and said magnetic material members are provided at positions circumferentially between respective adjacent pairs of said dielectric strips and at respective angles of approximately 120°; and wherein said magnetic material members are provided at a distance from said dielectric strips which is equal to or greater than ¼ of the wavelength of said dielectric wave guide; and said primary radiator and said nonreciprocal circuit device being electromagnetically coupled to each other.

15. The radio device according to claim 14, further comprising at least one of a receiving circuit and a transmitting circuit electromagnetically coupled to said nonreciprocal circuit device.

16. The radio device according to claim 14, wherein said primary radiator and nonreciprocal circuit device are electromagnetically coupled to each other by an additional dielectric waveguide.

17. The radio device according to claim 16, wherein said additional dielectric wave guide is an NRD guide.

18. The radio device according to claim 14, wherein said two magnetic field sources are magnets.

19. The radio device according to claim 14, wherein at least one of said two magnetic field sources is a magnetic pole.

20. The radio device according to claim 19, wherein the other of said two magnetic field sources is a magnet.

21. The radio device according to claim 14, wherein said magnetic material members enclose said dielectric wave guide and said magnetic field sources and form side walls of said dielectric wave guide.

22. The radio device according to claim 14, wherein said magnetic material members comprise screws made of magnetic material, which secure said magnetic field sources.

* * * * *